US007350326B2

(12) United States Patent
Hu

(10) Patent No.: US 7,350,326 B2
(45) Date of Patent: Apr. 1, 2008

(54) DOUBLE-SIDED DISPLAY

(75) Inventor: Shuo-Hsiu Hu, Tainan (TW)

(73) Assignee: AU Optronics Corporation, Hsinchu (TW)

( * ) Notice: Subject to any disclaimer, the term of this patent is extended or adjusted under 35 U.S.C. 154(b) by 287 days.

(21) Appl. No.: 11/182,209

(22) Filed: Jul. 15, 2005

(65) Prior Publication Data

US 2006/0230659 A1 Oct. 19, 2006

(30) Foreign Application Priority Data

Apr. 15, 2005 (TW) ..... 94112020 A

(51) Int. Cl.
*G09F 13/22* (2006.01)

(52) U.S. Cl. ..... 40/544; 439/67; 361/749; 257/59; 174/254

(58) Field of Classification Search ..... 439/67; 174/254; 361/749; 313/498, 503, 504; 349/59, 349/60, 149–153; 345/87; 257/59, 359
See application file for complete search history.

(56) References Cited

U.S. PATENT DOCUMENTS

| | | | | |
|---|---|---|---|---|
| 4,716,259 | A * | 12/1987 | Tokura et al. | 174/254 |
| 5,920,465 | A * | 7/1999 | Tanaka | 361/784 |
| 6,709,278 | B2 * | 3/2004 | Liu | 439/67 |
| 7,108,516 | B2 * | 9/2006 | Naitoh | 439/67 |
| 7,212,413 | B2 * | 5/2007 | Chang et al. | 361/749 |
| 2004/0207569 | A1 * | 10/2004 | Ho et al. | 345/1.1 |
| 2005/0179850 | A1 * | 8/2005 | Du | 349/150 |
| 2006/0146486 | A1 * | 7/2006 | Wikstrom et al. | 361/681 |

* cited by examiner

*Primary Examiner*—Joanne Silbermann
(74) *Attorney, Agent, or Firm*—Birch, Stewart, Kolasch & Birch, LLP

(57) ABSTRACT

A double-sided display is provided. The double-sided display includes two display panels comprising electroluminescene panels, organic light emitting panels, and polymer light emitting panels. The two display panels are stacked partially overlapped. A flexible printed circuit board having a bending portion adapted for electrically connecting with the two display panels.

21 Claims, 5 Drawing Sheets

DOUBLE-SIDED DISPLAY

FIELD OF THE INVENTION

The present invention relates to a double-sided display, and more particularly relates to a double-sided display including an integrated printed circuit and two display panels partially overlapped each other.

DESCRIPTION OF THE RELATED ART

A normal double-sided display used in the electronic products includes two display panels disposed back-to-back to each other. And the two display panels are connected respectively with the corresponding printed circuits and the integrated circuits (IC). However, by the trend of light weight and thin thickness of the electronic products, the excess and complicated circuits of the conventional double-sided display would not meet the requirements of this trend of the electronic products. And the way to connect the printed circuit of the two display panels and the integrated circuit (IC) together without affecting the output of the normal display is a very important issue in design.

SUMMARY OF THE INVENTION

According to the above description of the related art, since the front and back display panels of the conventional double-sided display need to be connected with different printed circuit boards and integrated circuit, the conventional double-sided display can't meet the requirements of simplification, low weight and thin thickness. Therefore, a double-sided display is provided herein. This double-sided display is provided to simplify the circuit design or layout of the double-sided display and reduce the amount of the devices to achieve the requirement of low weight and thin thickness. The present invention also provides a printed circuit board design to meet the requirements of the display panels of the double-sided display without affecting the normal output of the display panels.

According to the purposes described above, a double-sided display is provided which includes two display panels stacked partially overlapped and a flexible printed circuit board bonded with two electrical bonding areas after being bended and exposing the display area of the double-sided display via an opening.

BRIEF DESCRIPTION OF THE DRAWINGS

The accompany drawings incorporated in and forming a part of the specification illustrate several aspects of the present invention, and together with the description serve to explain the principles of the invention. In the drawings.

DESCRIPTION OF THE PREFERRED EMBODIMENT

The following detailed description of the present invention describes a double-sided display necessary to provide an understanding of the present invention, but does not cover a complete structure composition and the operating theory.

The portions related to the conventional techniques are briefly described, and the parts of the drawings are not proportionally drafted. While embodiments are discussed, it is not intended to limit the scope of the present invention. Except expressly restricting the amount of the components, it is appreciated that the quantity of the disclosed components may be greater than that disclosed.

Figure 1A:
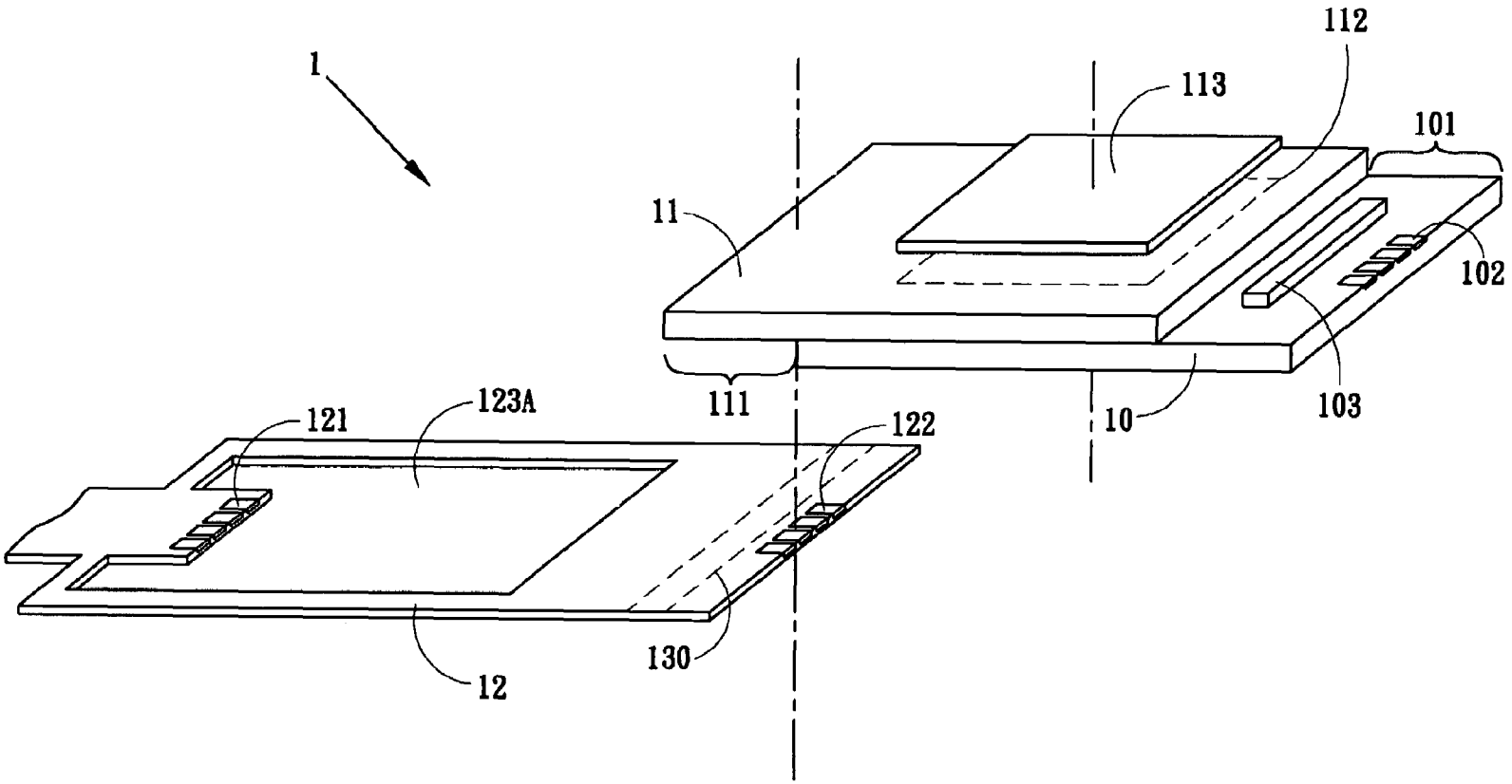
FIG. 1A-1C are assembling process drawings illustrating a double-sided display provided in the preferred embodiment of the present invention.

Referring to FIG. 1A, according to a double-sided display provided in a preferred embodiment of the present invention, the double-sided display 1 includes a first display panel 10, a second display panel 11, and a printed circuit board 12 for providing driving signals. In order to reduce the thickness of the double-sided display 1 and consider the convenience of the connecting operation of the first display panel 10 and the second display panel 11 together with the printed circuit board 12, the first display panel 11 and the second display panel 12 are connected and partially overlapped so that a first bonding area 101 and a second bonding area 111 thereof are exposed and a first edge connector 102 and a second edge connector (not shown) are exposed as well.

Besides, a first polarizer (not shown) and a second polarizer 113 can be disposed on the first display region (not shown) of the first display panel 10 and the second display region 112 of the second display panel 11, respectively. A first integrated circuit (IC) 103 and a second integrated circuit (IC) (not shown) for processing driving signals can be disposed on the first bonding area 101 and the second bonding area 111, respectively. Furthermore, the first integrated circuit (IC) 103 or the second integrated circuit (not shown) can also be disposed on the printed circuit board 12, and connected with the first bonding area 101 or the second bonding area 111, respectively.

In the embodiment of the present invention, since the printed circuit board 12, which may be a flexible printed circuit board for example, can be connected with the first display panel 10 and the second display panel 11, can be used to expose the third edge connector 121 and the fourth edge connector 122 which can connect with the first edge connector 102 and the second edge connector (not shown), respectively.

Still referring to FIG. 1A, the printed circuit board 12 and the second display panel 11 partially overlapped can be connected, wherein the fourth edge connector 122 and the second edge connector (not shown) are connected by pressing processes. After the fourth edge connector 122 and the second edge connector (not shown) are connected, as shown in FIG. 1B, through the bending portion 130, therefore the printed circuit board 12 can be bent and easily connect the third edge connector 121 and the first edge connector 102.

Figure 1B:
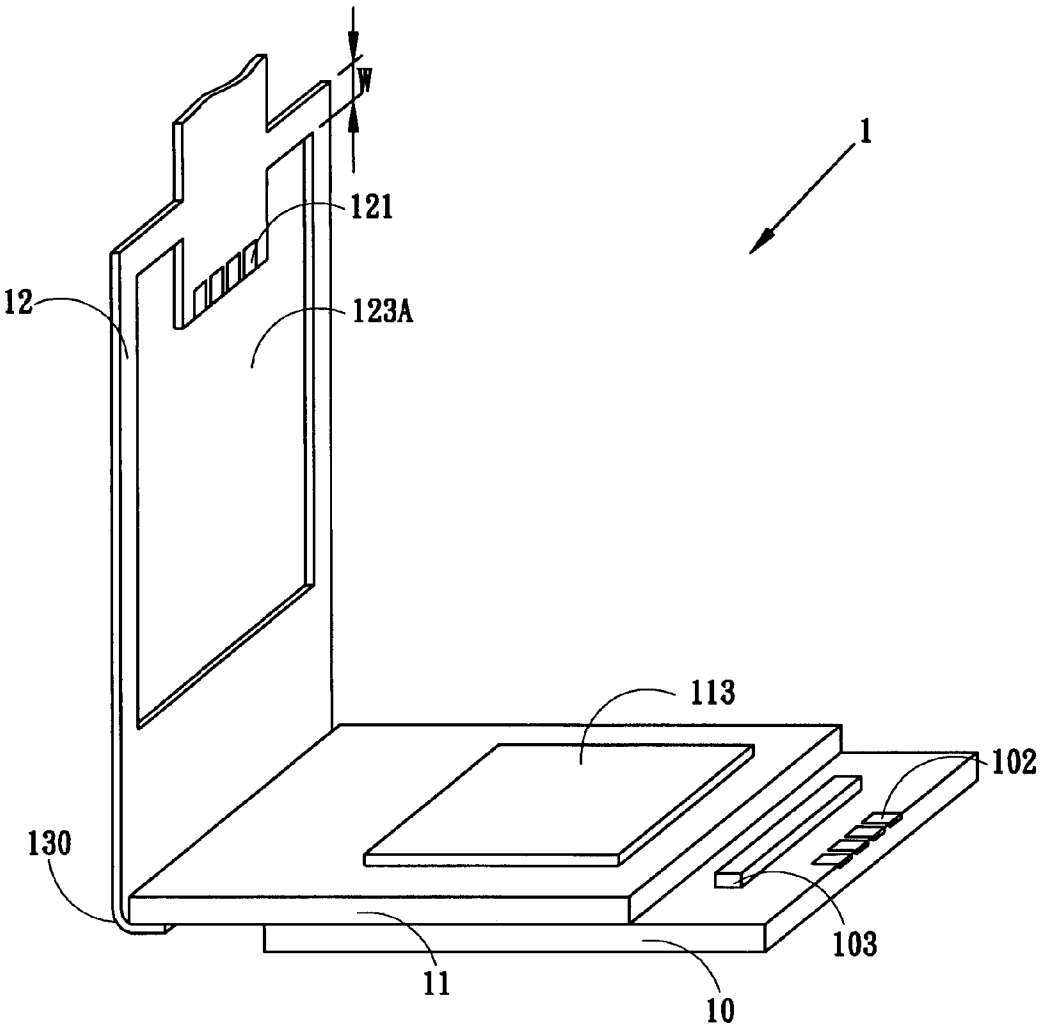
Figure 1C:
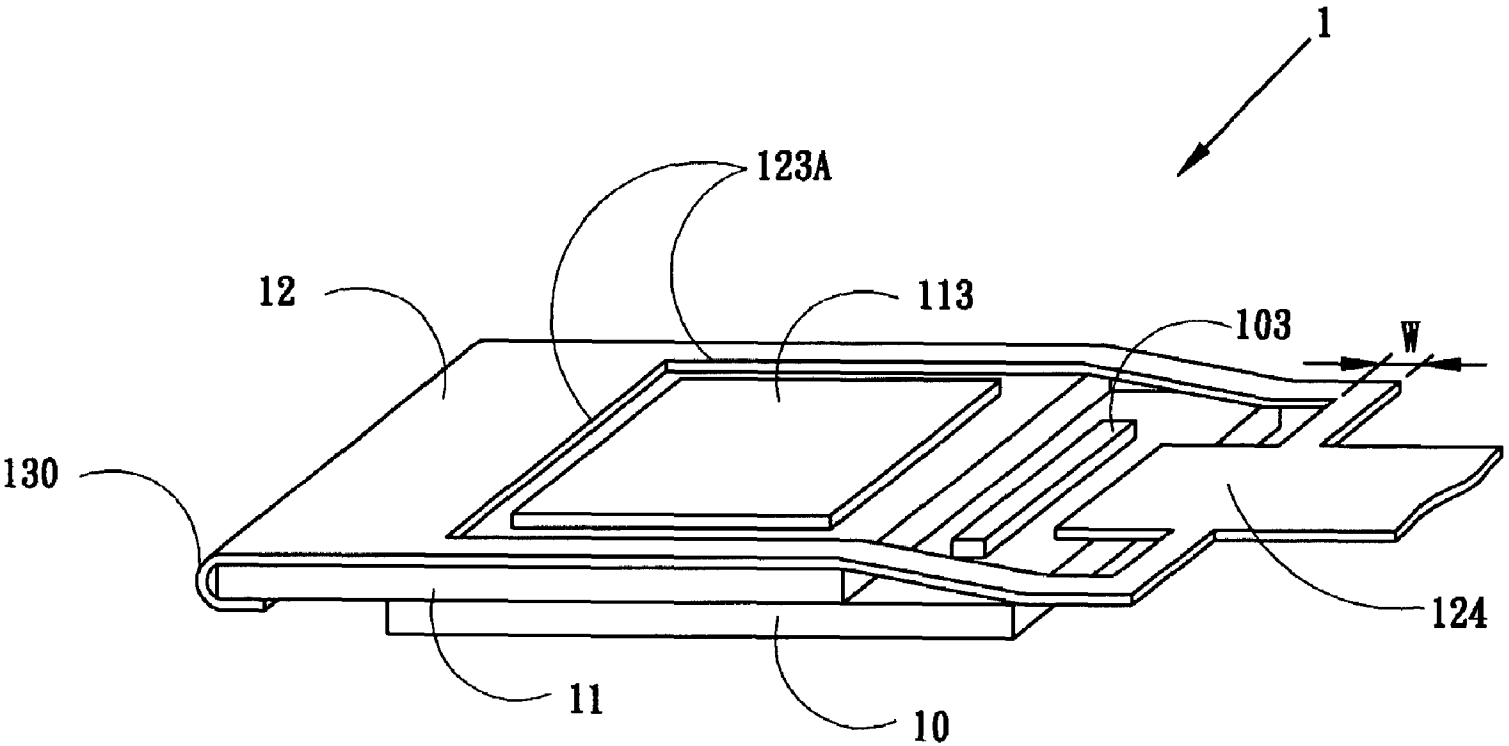

Referring to FIG. 1B and FIG. 1C, in order not to affect the normal display of the second display panel 11 and to avoid increasing the thickness of the whole double-sided display 2, an opening 123A structure is formed between the fourth edge connector 122 and the third edge connector 121 on the printed circuit board 12 so that when the third edge connector 121 and the first edge connector 102 are connected by pressing processes as shown in FIG. 1C, the second polarizer 113 disposed on the second display region 112 can be disposed within the region of the opening 123A without overlapping the printed circuit board 12. The area of the second polarizer 113 can be smaller than the area of the opening 123A. Besides, in order to reduce the retracting force resulting from the connection of the fourth edge connector 122 and the second edge connector (not shown) by pressing processes, which would affect the connection of the third edge connector 121 and the first edge connector 102. Therefore, the width W of the connecting area of the fourth edge connector 122 and the third edge connector 121 on the printed circuit board 12 is reduced. In order to achieve a smooth connection between the third edge connecter 121 and the first edge connecter 102, the region 124 of the printed circuit board 12 closed to the third edge connector 121 is made of a continuous copper layer to increase the strength of the printed circuit board 12.

Figure 2A:
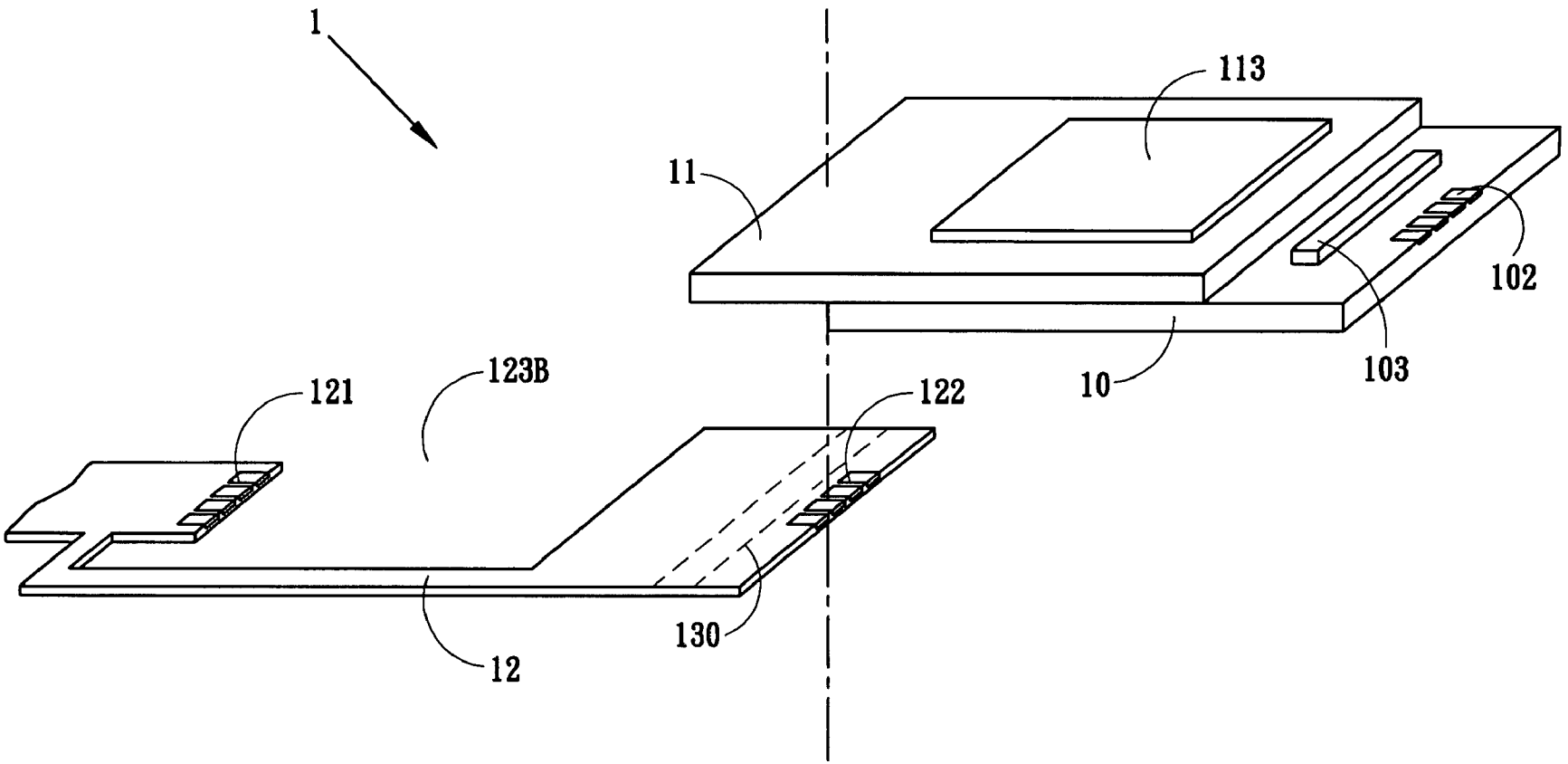
FIG. 2A-2B are assembling process drawings illustrating a double-sided display provided in another preferred embodiment of the present invention.
Figure 2B:
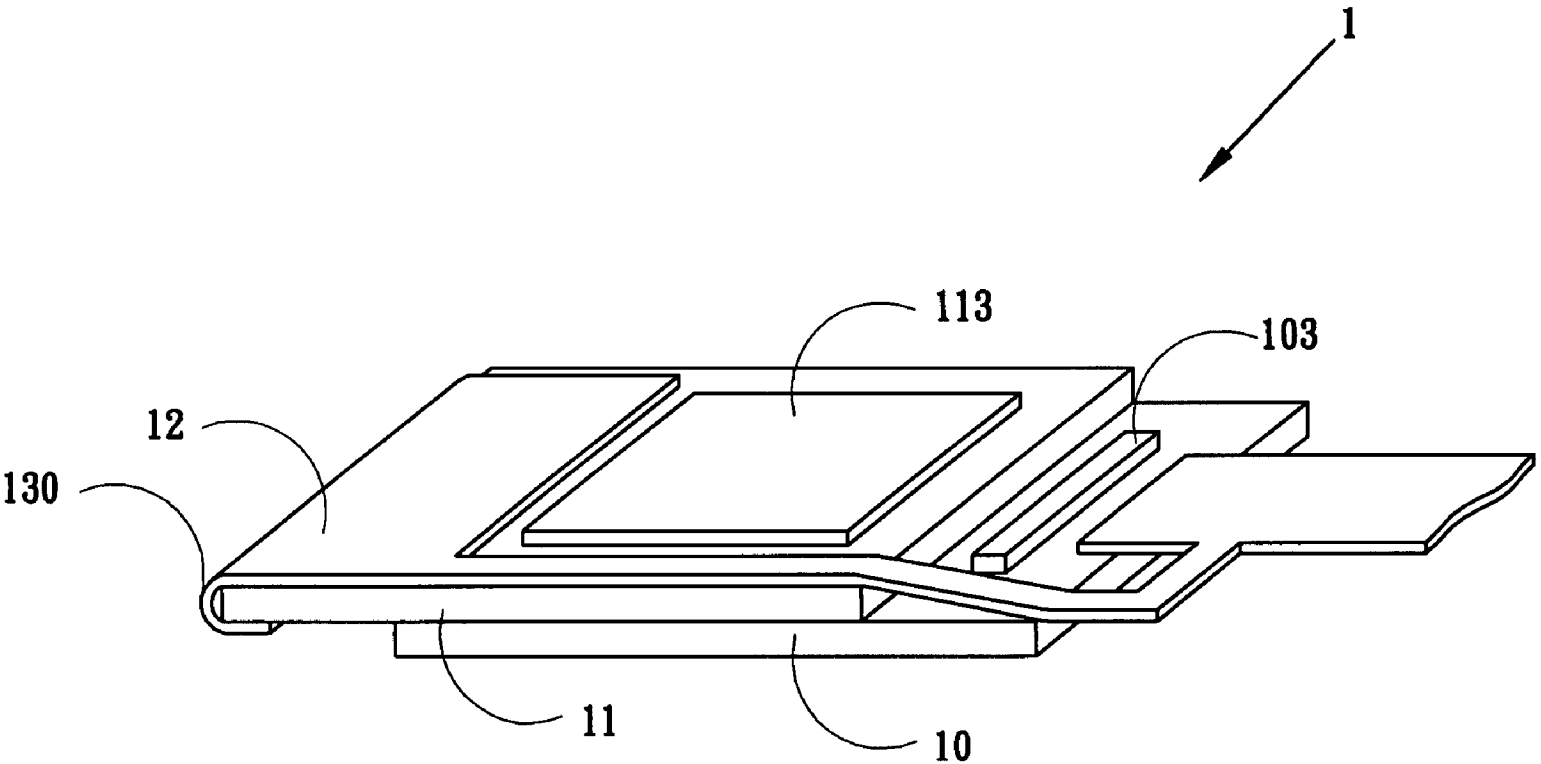

Referring to FIG. 1A, the opening 123A formed in the printed circuit board 12 is a closed opening. However, in another embodiment of the present invention, referring to FIG. 2A, the opening 123B formed in the printed circuit board 12 is a non-closed opening. The fourth edge connector 122 and the third edge connector 121 formed neighboring to the opening 123B can be sequentially connected with the second edge connector (not shown) of the second display panel 11 and the first edge connector 102 of the first display panel 10.

According to the embodiments of the present invention described above, electroluminescene (EL) panels, such as organic light emitting diode (OLED) panels or polymer light emitting diode (PLED) panels, can be used respectively or together in the first display panel 10 and the second display panel 11. And the first integrated circuit 103 disposed on the first display panel 10 and the second integrated circuit (not shown) disposed on the second display panel 11 can be integrated into one integrated circuit disposed on any one of the display panels and reduce the amount of devices of the double-sided display.

The foregoing description is not intended to be exhaustive or to limit the invention to the precise forms disclosed. Obvious modifications or variations are possible in light of the above teachings. In this regard, the embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claim is:

1. A double-sided display comprising:

a first display panel having a first bonding area and a first display region;

a second display panel, disposed on the back of said first display panel, having a second bonding area and a second display region; and a flexible printed circuit board having a first edge connector and a second edge connector for electrically connecting with said first bonding area and said second bonding area, respectively, and an opening formed between said first edge connector and said second edge connector to expose said second display region.

2. The double-sided display of claim 1, wherein said flexible printed circuit board comprises a bending portion adapted for connecting said first display panel and for connecting said second display panel.

3. The double-sided display of claim 2, wherein said opening is a closed opening.

4. The double-sided display of claim 2, wherein said opening is a non-closed opening.

5. The double-sided display of claim 1, further comprising a first integrated circuit and a second integrated circuit disposed on said first display panel and said second display panel, respectively.

6. The double-sided display of claim 1, further comprising an integrated circuit disposed on said first display panel.

7. The double-sided display of claim 1, wherein said first display panel and said second display panel are electroluminescene light emitting diode panels.

8. The double-sided display of claim 7, wherein said electroluminescene panel is an organic light emitting diode panel.

9. The double-sided display of claim 7, wherein said electroluminescene panel is a polymer light emitting diode panel.

10. The double-sided display of claim 1, further comprising an integrated circuit disposed on said flexible printed circuit board.

11. The double-sided display of claim 1, wherein said opening is a closed opening.

12. The double-sided display of claim 1, wherein said opening is a non-closed opening.

13. A double-sided display comprising:

a first display panel having a first edge connector;

a second display panel having a second edge connector, wherein said first display panel and said second display panel are partially overlapped, and said first edge connector and said second edge connector are exposed; and a flexible printed circuit board having:

a third edge connector and a fourth edge connector pointing to a same direction;

a bending portion adapted for electrically connecting said third edge connector and said first edge connector, and for electrically connecting said fourth edge connector and second edge connector; and an opening formed between said third edge connector and said fourth edge connector to expose a portion of said second display panel.

14. The double-sided display of claim 13, wherein said opening is a closed opening.

15. The double-sided display of claim 13, wherein said opening is a non-closed opening.

16. The double-sided display of claim 13, further comprising a first integrated circuit and a second integrated circuit disposed on said first display panel and said second display panel, respectively.

17. The double-sided display of claim 13, further comprising an integrated circuit disposed on said first display panel.

18. The double-sided display of claim 13, further comprising an integrated circuit disposed on said flexible printed circuit board.

19. The double-sided displays of claim 13, wherein said first display panel and said second display panel are electroluminescene panels.

20. The double-sided display of claim 19, wherein said electroluminescene panel is an organic light emitting diode panel.

21. The double-sided display of claim 19, wherein said electroluminescene panel is a polymer light emitting diode panel.

* * * * *